US011644176B2

(12) United States Patent
Park

(10) Patent No.: US 11,644,176 B2
(45) Date of Patent: May 9, 2023

(54) DEVICE AND METHOD FOR CONTROLLING HEAT DISSIPATION OF LED LAMP FOR VEHICLE

(71) Applicants: Hyundai Motor Company, Seoul (KR); Kia Corporation, Seoul (KR)

(72) Inventor: Moon Soo Park, Gwangmyeong-si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/490,041

(22) Filed: Sep. 30, 2021

(65) Prior Publication Data

US 2022/0163184 A1 May 26, 2022

(30) Foreign Application Priority Data

Nov. 26, 2020 (KR) ..... 10-2020-0160743

(51) Int. Cl.
*F21S 45/43* (2018.01)
*F21S 41/141* (2018.01)
*F21S 45/47* (2018.01)

(52) U.S. Cl.
CPC ..... *F21S 45/43* (2018.01); *F21S 41/141* (2018.01); *F21S 45/47* (2018.01)

(58) Field of Classification Search
CPC ..... F21S 41/141; F21S 43/14; F21S 45/43; F21S 45/42; F21S 45/47; F21Y 2115/10
See application file for complete search history.

(56) References Cited

U.S. PATENT DOCUMENTS 5,419,780 A * 5/1995 Suski ..... H01L 35/30 136/224
2009/0034202 A1* 2/2009 Chiu ..... G06F 1/26 361/704
2009/0059594 A1* 3/2009 Lin ..... F21S 45/46 362/294
2010/0271802 A1* 10/2010 Recker ..... H05B 45/12 362/20
2018/0231207 A1* 8/2018 Shin ..... F21S 45/60

FOREIGN PATENT DOCUMENTS

EP 3740042 A1 * 11/2020 ..... F21V 29/54
JP 2006253545 A * 9/2006
WO WO-2006066532 A1 * 6/2006 ..... F21K 9/00

OTHER PUBLICATIONS

Search English translation of WO-2006066532-A1 (Year: 2006).*
Search English translation of EP-3740042-A1 (Year: 2020).*
Search English translation of JP-2006253545-A (Year: 2006).*

* cited by examiner

*Primary Examiner* — Omar Rojas Cadima
(74) *Attorney, Agent, or Firm* — Slater Matsil, LLP

(57) ABSTRACT

An embodiment method for controlling heat dissipation of an LED lamp includes applying power to a first light source element to light the first light source element, generating a current using heat dissipation of the first light source element, supplying the current to a fan to drive the fan, and removing a residual heat of the first light source element using cold air generated by the fan.

20 Claims, 7 Drawing Sheets

DEVICE AND METHOD FOR CONTROLLING HEAT DISSIPATION OF LED LAMP FOR VEHICLE

CROSS-REFERENCE TO RELATED APPLICATIONS

This application claims the benefit of Korean Patent Application No. 10-2020-0160743, filed on Nov. 26, 2020, which application is hereby incorporated herein by reference.

TECHNICAL FIELD

The present disclosure relates to heat dissipation control of an LED for a vehicle.

BACKGROUND

As application of an LED to a lamp for a vehicle is becoming more common, importance of a technology for dissipating a heat of an LED element is emerging.

In addition, as eco-friendly vehicles are becoming more and more widespread, how efficiently power in the vehicle is used is expected to be an important indicator in responding to various regulations in the future.

An LED currently used for the vehicle satisfies a heat dissipation performance through derating in an overheating condition, separate fan application, and the like. In addition, in terms of power optimization, research and development are being conducted in a direction of optimizing a light distribution performance to a level satisfactory in environmental regulations such as eco-innovation and the like.

In a conventional driving scheme using a fan and a temperature sensor, a temperature of the LED element is measured using a negative temperature coefficient of resistance (NTC), and the fan is operated when the measured temperature rises to be equal to or above a reference value, thereby satisfying the heat dissipation performance. However, because of a design trend of vehicles currently being released, the number of LED elements mounted on the vehicle is increasing rapidly. In this connection, when the number of NTC elements increases together with the increase of the number of LED elements mounted on the vehicle, circuit complexity increases rapidly.

In addition, in a case of a conventional fan constant driving scheme, the fan is operated at all times when lighting a low/high lamp regardless of the temperature of the LED element, so that there are problems of excessive fan driving and unnecessary power consumption resulted therefrom.

In addition, in a case of a conventional derating scheme, a scheme of lowering the temperature of the LED element by reducing a current value (a light distribution performance) when the measured temperature of the LED element rises to be equal to or above a specific temperature was adopted. However, there was a problem of not being able to be applied to a system that deteriorates in performance in a specific condition and generates heat at a level equal to or above a specific level.

Accordingly, there is a need to implement a high-performance/low-power LED lamp for the vehicle that minimizes unnecessarily used power while securing the heat dissipation performance of the LED applied to the lamp for the vehicle at the same time.

SUMMARY

The present disclosure relates to heat dissipation control of an LED for a vehicle. Particular embodiments relate to a technology for improving a heat dissipation performance and a power efficiency of an LED lamp for the vehicle using a thermoelement.

Embodiments of the present disclosure can solve problems occurring in the prior art while advantages achieved by the prior art are maintained intact.

An embodiment of the present disclosure provides a device and a method for controlling heat dissipation of an LED lamp for a vehicle using a thermoelement.

Another embodiment of the present disclosure provides a device and a method for controlling heat dissipation of an LED lamp for a vehicle that arrange a headlamp, a fan, and a thermoelement such that the Seebeck effect may be used when lighting a low/high lamp of the LED lamp for the vehicle and the Peltier effect may be used when lighting a daytime running light (DRL)/a position lamp (PSTN), thereby utilizing a heat generated from the headlamp and a heat consumed by a resistance as power for LED heat dissipation.

The technical problems to be solved by embodiments of the present inventive concept are not limited to the aforementioned problems, and any other technical problems not mentioned herein will be clearly understood from the following description by those skilled in the art to which the present disclosure pertains.

According to an embodiment of the present disclosure, a method for controlling heat dissipation of an LED lamp for a vehicle includes applying power to a first light source element to light the first light source element, generating a current using heat dissipation of the first light source element, supplying the generated current to a fan to drive the fan, and removing a residual heat of the first light source element using cold air generated by the driven fan.

In one implementation, the first light source element may be an LED low/high lamp.

In one implementation, the current may be generated by a thermoelement, and the current may be generated by an electromotive force generated based on a temperature difference between both surfaces of the thermoelement resulted from the heat dissipation.

In one implementation, the method may further include applying power to a second light source element to light the second light source element, and applying residual power of the second light source element to a thermoelement, and the second light source element may include a daytime running light and a position lamp.

In one implementation, an end of a circuit of the second light source element and one surface of the thermoelement may be connected to each other, so that the residual power may be applied to the thermoelement.

In one implementation, a temperature difference between both surfaces of the thermoelement may occur as the residual power is applied, and the residual heat of the first light source element may be removed using cold air formed on the other surface of the thermoelement.

In one implementation, one surface of a thermoelement may be embodied in a form of a substrate by stacking a light absorber.

In one implementation, a thermoelement may be attached to a housing or a heat sink corresponding to a heat dissipation portion of the first light source element.

In one implementation, the method may further include supplying the generated current to a battery.

In one implementation, the method may further include supplying the generated current to another light source element.

According to another embodiment of the present disclosure, a system for controlling heat dissipation of an LED lamp for a vehicle includes a first light source element, an LED drive module that applies power to the first light source element to light the first light source element, a thermoelement that generates a current using heat dissipation of the first light source element, and a fan driven by receiving the generated current as power, and a residual heat of the first light source element is removed using cold air generated by the driven fan.

In one implementation, the first light source element may be an LED low/high lamp.

In one implementation, the current may be generated by the thermoelement, and the current may be generated by an electromotive force generated based on a temperature difference between both surfaces of the thermoelement resulted from the heat dissipation.

In one implementation, the system may further include a second light source element driven by receiving power from the LED drive module, residual power of the second light source element may be applied to the thermoelement, and the second light source element may include a daytime running light and a position lamp.

In one implementation, an end of a circuit of the second light source element and one surface of the thermoelement may be connected to each other, so that the residual power may be applied to the thermoelement.

In one implementation, a temperature difference between both surfaces of the thermoelement may occur as the residual power is applied, and the residual heat of the first light source element may be removed using cold air formed on the other surface of the thermoelement.

In one implementation, one surface of the thermoelement may be embodied in a form of a substrate by stacking a light absorber.

In one implementation, the thermoelement may be attached to a housing or a heat sink corresponding to a heat dissipation portion of the first light source element.

In one implementation, the system may further include a battery charged by receiving the current generated on the thermoelement.

In one implementation, the system may further include a third light source element driven by receiving the generated current.

The technical problems to be solved by the present inventive concept are not limited to the aforementioned problems, and any other technical problems not mentioned herein will be clearly understood from the following description by those skilled in the art to which the present disclosure pertains.

BRIEF DESCRIPTION OF THE DRAWINGS

The above and other objects, features and advantages of embodiments of the present disclosure will be more apparent from the following detailed description taken in conjunction with the accompanying drawings, in which.

DETAILED DESCRIPTION OF ILLUSTRATIVE EMBODIMENTS

Figure 1A:
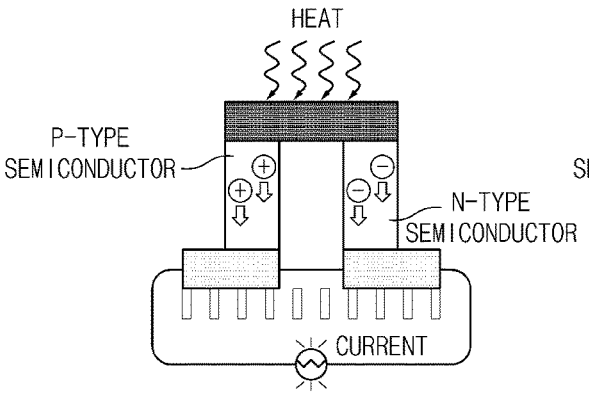
FIGS. 1A-1D are views for illustrating an operation of a thermoelement according to an embodiment.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiments of the present disclosure, a detailed description of the related known configuration or function will be omitted when it is determined that it interferes with the understanding of the embodiments of the present disclosure.

In describing the components of the embodiments according to the present disclosure, terms such as first, second, A, B, (a), (b), and the like may be used. These terms are merely intended to distinguish the components from other components, and the terms do not limit the nature, order or sequence of the components. Unless otherwise defined, all terms including technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiments of the present disclosure will be described in detail with reference to FIGS. 1A to 7.

FIGS. 1A-1D are views for illustrating an operation of a thermoelement according to an embodiment.

Figure 1B:
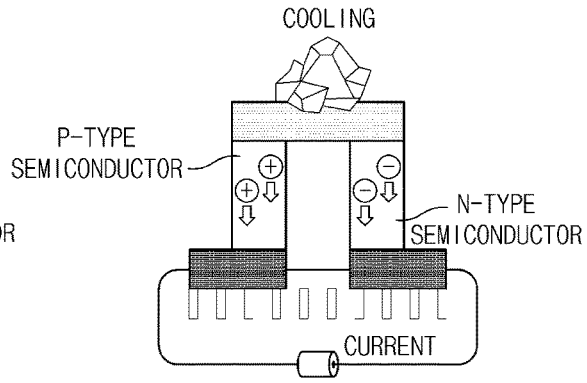
Figure 1C:
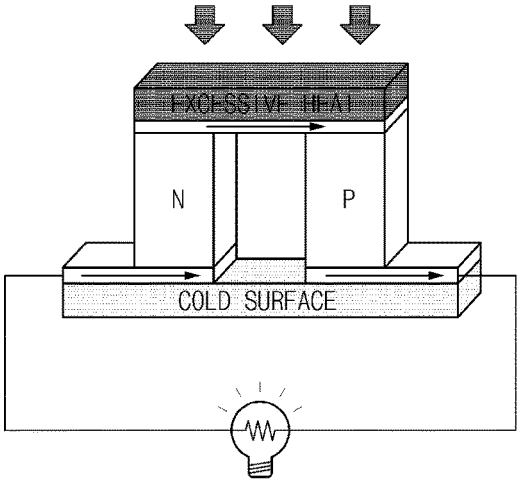

Referring to FIG. 1A and FIG. 1C, when heat is applied to an upper conductor, both electrons (−) and positive holes (+) move downward, and a potential difference occurs at both ends of each of both n-type and p-type semiconductors. In this connection, a flow of electric charges (current) is generated and a light bulb is lit.

Figure 1D:
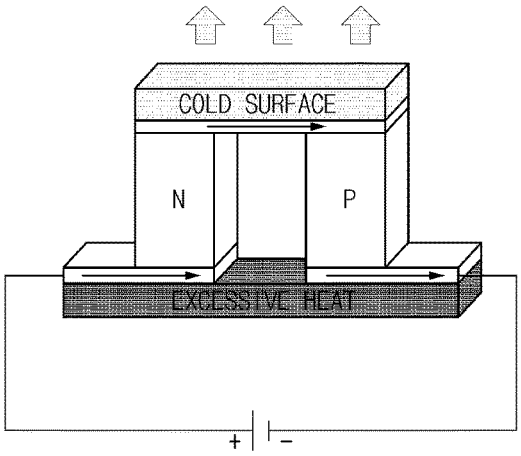

On the other hand, referring to FIG. 1B and FIG. 1D, when electricity is supplied to a dry battery, the electrons (−) and the positive holes (+) move downward. In this connection, a side with a higher density of the electrons/the positive holes becomes hot and a side with a lower density of the electrons/the positive holes becomes cold.

Figure 2A:
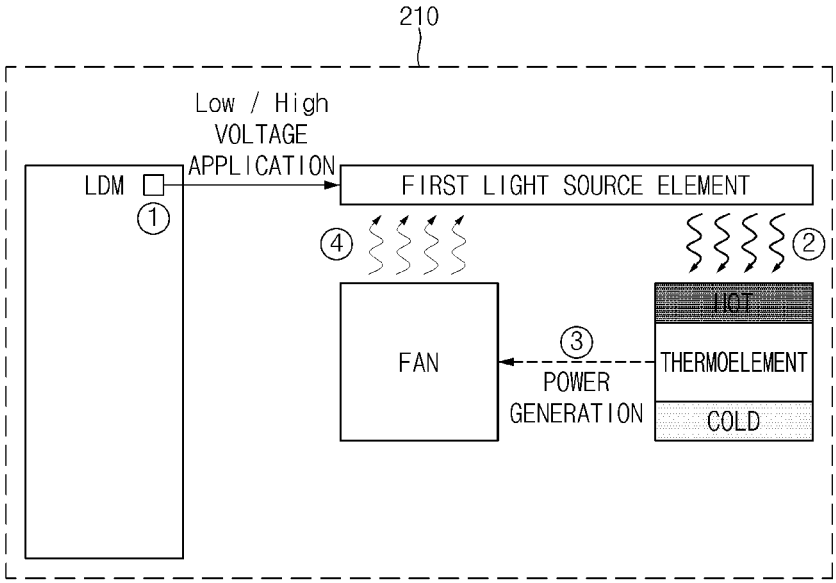
FIGS. 2A and 2B are views for illustrating the Seebeck effect and the Peltier effect, respectively, according to an embodiment.
Figure 2B:
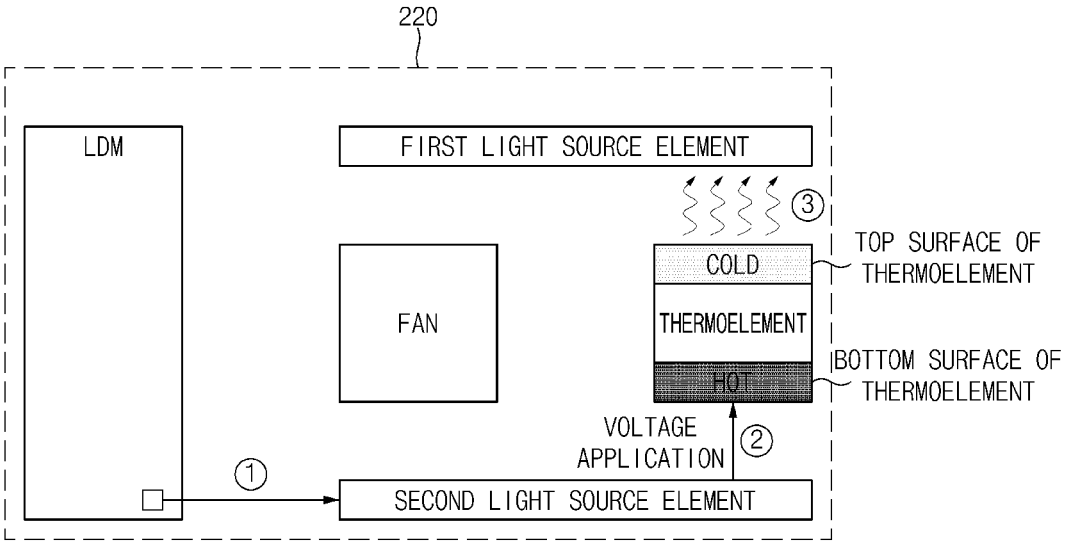

FIGS. 2A and 2B are views for illustrating the Seebeck effect and the Peltier effect, respectively, according to an embodiment.

Referring to FIG. 2A, a reference number 210 is a diagram for illustrating the Seebeck effect, and referring to FIG. 2B, a reference number 220 is a diagram for illustrating the Peltier effect.

Referring to the reference number 210 of FIG. 2A, an LED drive module (LDM) may light a first light source element by applying power to the first light source element, for example, an LED low/high beam lamp. In this connection, a top surface of a thermoelement is heated by heat generated from a light source, resulting in a temperature difference between both surfaces of the thermoelement, which causes the current to flow. A fan may be driven by applying the current generated by the thermoelement to the fan. That is, a structure for lowering the heat generated from the light source by driving the fan with the current generated using the heat generated from the light source may be formed. A heat dissipation effect using the structure of the reference number 210 is referred to as the Seebeck effect.

Referring to the reference number 220 of FIG. 2B, the LDM may light a second light source element by applying power to the second light source element, for example, a daytime running light (DRL)/a position lamp (PSTL). In this connection, when flowing a current of a resistance consumed as heat, that is, a residual voltage of the second light source element, of a current applied when the second light source element (DRL/PSTL) is lit to the thermoelement, a surface at a side of the first light source element, that is, the top surface of the thermoelement, may be formed as a cold surface. In this connection, the top surface of the thermoelement cooled by the residual voltage supplied from the second light source element may lower a temperature of the heated first light source element. That is, a structure for cooling residual heat of the first light source element using the residual voltage generated when the second light source element is lit may be formed.

That is, a system for dissipating a heat of an LED lamp for a vehicle according to an embodiment has an advantage of using both the Seebeck effect and the Peltier effect based on the driving of the LED lamp for the vehicle.

Figure 3:
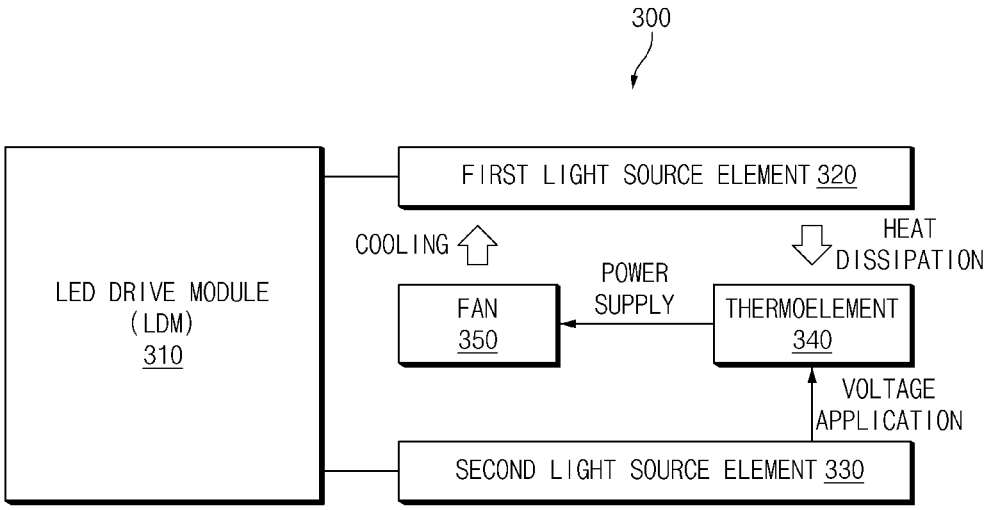
FIG. 3 is a structure of a system for dissipating a heat of an LED lamp for a vehicle according to an embodiment.

FIG. 3 is a structure of a system for dissipating a heat of an LED lamp for a vehicle according to an embodiment.

Referring to FIG. 3, a system 300 for dissipating a heat of an LED lamp for a vehicle may include an LED drive module (LDM) 310, a first light source element 320, a second light source element 330, a thermoelement 340, and a fan 350.

As an example, the first light source element 320 may be the LED low/high lamp, and the second light source element 330 may be the daytime running light (DRL)/the position lamp (PSTN).

The LED drive module 310 may control driving of the first light source element 320 and the second light source element 330.

The second light source element 330 may be connected to the thermoelement 340 to apply a voltage to the thermoelement 340 when being lit.

Figure 4:
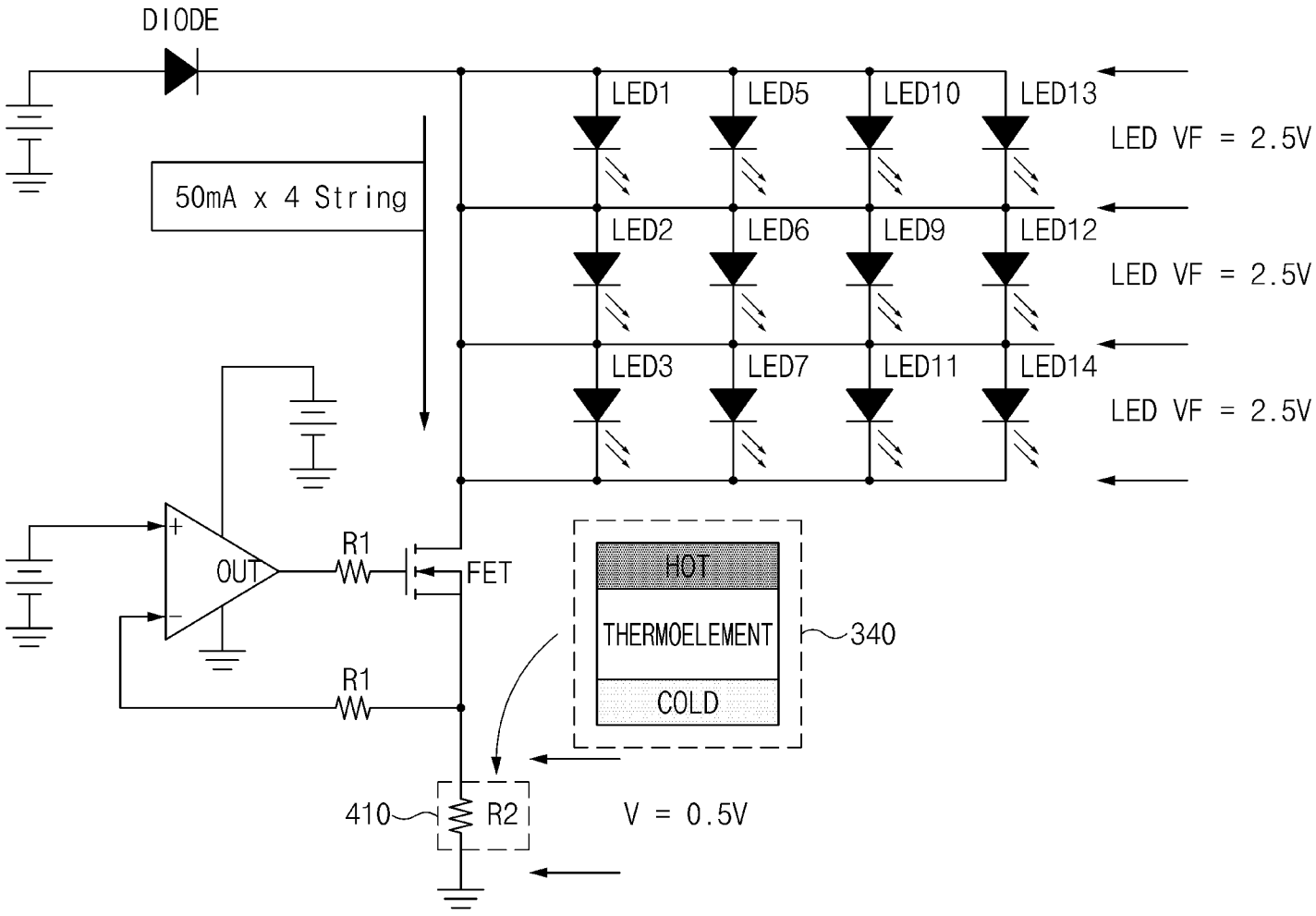
FIG. 4 is a view for illustrating a circuit structure of a second light source element according to an embodiment.

As shown in FIG. 4, the second light source element 330 may be constructed such that the voltage is supplied to the thermoelement 340 by connecting the thermoelement 340 to an end of a signal lighting circuit instead of connecting a resistance element 410.

The thermoelement 340 may supply internally generated power to the fan 350. In this connection, the thermoelement 340 may supply power generated based on a heat dissipated from the first light source element 320 and/or the voltage applied from the second light source element 330, that is, current, to the fan 350 to drive the fan 350. That is, the thermoelement 340 may drive the fan 350 with power generated by a temperature difference between top and bottom surfaces thereof.

The thermoelement 340 may be attached to a portion, for example, a housing or a heat sink, that emits an excessive heat to the outside when the first light source element 320 is lit.

The fan 350 may be driven using the power supplied from the thermoelement 340. In this connection, the fan 350 may be used to cool a residual heat of the first light source element 320.

That is, the system 300 for dissipating the heat of the LED lamp for the vehicle according to an embodiment has an advantage of maximizing a power efficiency using both the Seebeck effect and the Peltier effect based on the driving of the LED lamp for the vehicle.

FIG. 4 is a view for illustrating a circuit structure of a second light source element according to an embodiment.

Referring to FIGS. 3 and 4, the thermoelement 340 may be connected instead of the resistance element 410, that is, $R_2$ at the end of the circuit of the second light source element 330.

Through a structure of the circuit, a residual voltage of the second light source element 330 may be applied to the thermoelement 340.

Figure 5B:
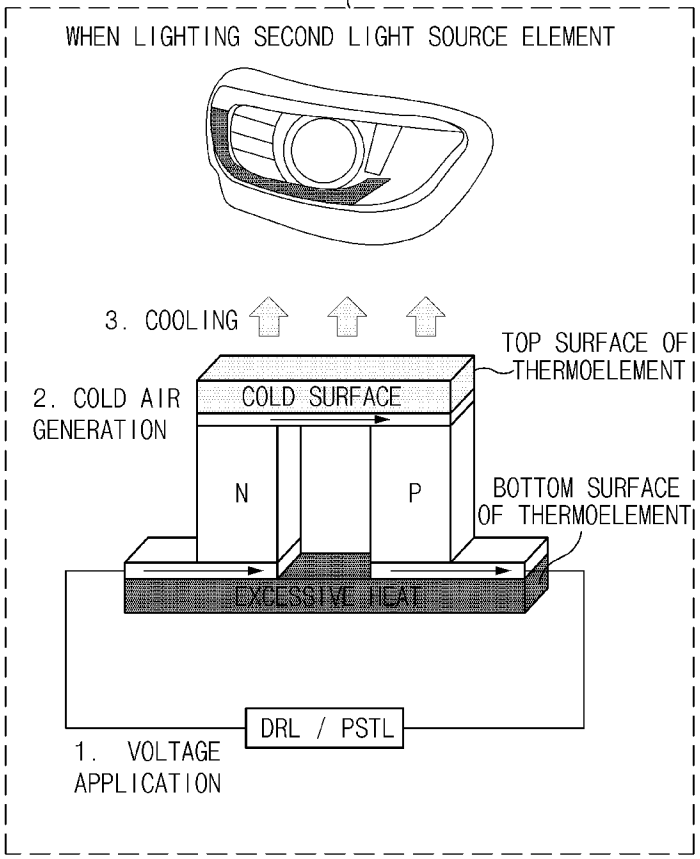
FIGS. 5A and 5B are views for illustrating an operation of a system for dissipating a heat of an LED lamp for a vehicle using a thermoelement according to an embodiment.
Figure 5A:
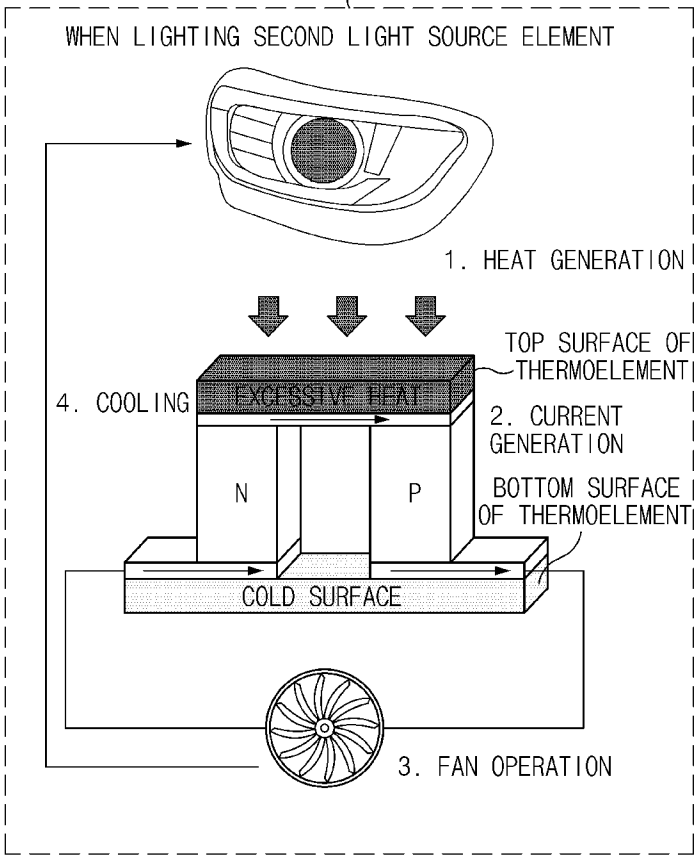

FIGS. 5A and 5B are views for illustrating an operation of a system for dissipating a heat of an LED lamp for a vehicle using a thermoelement according to an embodiment.

A reference number 510 of FIG. 5A shows a process of dissipating a heat of the LED low/high beam lamp, which is the first light source element, using the thermoelement and the fan by utilizing the Seebeck effect. Specifically, referring to the reference number 510, when the heat generated by the first light source element is transferred to the top surface of the thermoelement, an electromotive force is generated on a thermoelectric leg by the temperature difference between the surfaces of the thermoelement, so that the current flows. That is, the current flows from the n-type semiconductor to the p-type semiconductor of the thermoelectric leg. In this connection, the current generated from the thermoelement is supplied to the fan, and wind generated by the fan cools the residual heat of the first light source element. The top surface of the thermoelement may be embodied in a form of a substrate by thinly stacking a light absorber, for example, $Ti/MgF_2$.

A reference numeral 520 of FIG. 5B shows a process of dissipating a residual heat of the DRL/PSTL, which is the second light source element, by supplying residual power of the DRL/PSTL to the thermoelement by utilizing the Peltier effect. Specifically, referring to the reference numeral 520, when a voltage is applied to the second light source element, a residual voltage of the second light source element is applied to a bottom surface of the thermoelement. In this connection, a temperature of the bottom surface of the thermoelement increases and a temperature of the top surface of the thermoelement decreases. The residual heat of the second light source element may be removed through cold air on the top surface of the thermoelement whose temperature is lowered.

In the embodiment of FIGS. 5A and 5B above, the example is shown that the thermoelement is embodied as the thermoelectric leg, which is the n-type and p-type semiconductors with a phenomenon in which the electromotive force is generated and accordingly the current flows when there is the temperature difference between the surfaces in the form of the substrate of the thermoelement. However, this is merely an embodiment. A thermoelement according to another embodiment may be constructed using a thermoelectric semiconductor element such as bismuth tellurite ($Bi_2Te_3$) having the highest thermoelectric conversion coefficient (efficiency) at a room temperature.

Figure 6:
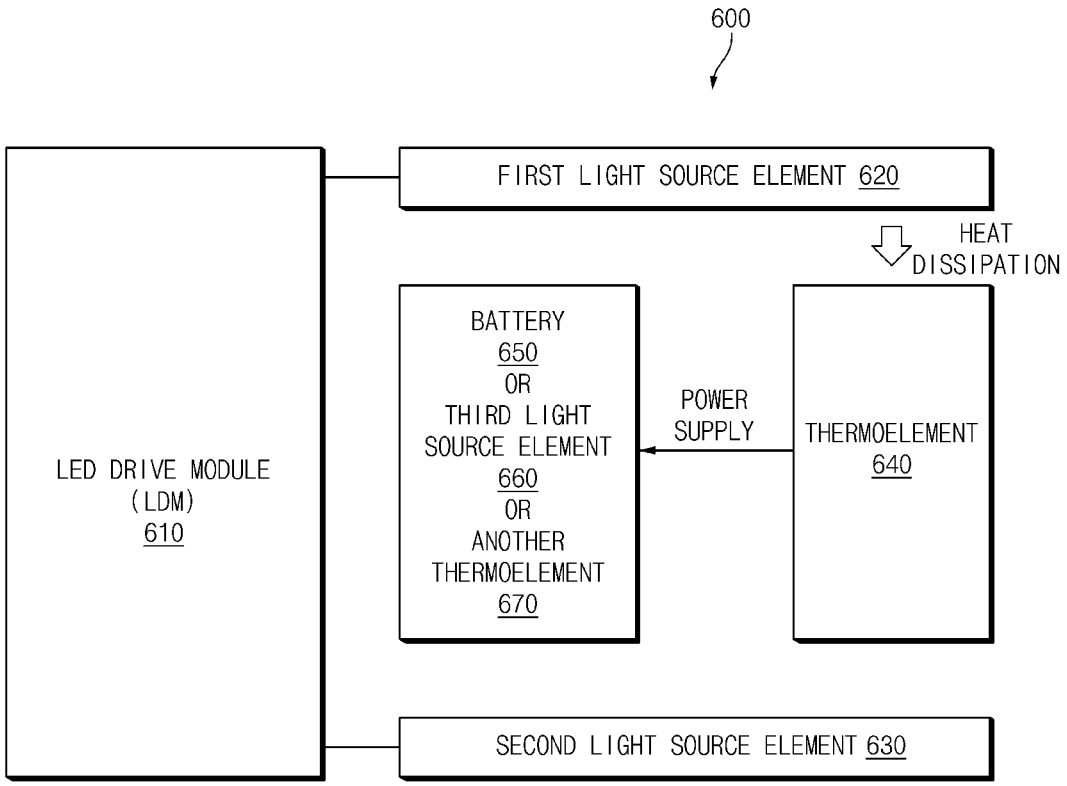
FIG. 6 is a structure of a system for dissipating a heat of an LED lamp for a vehicle according to another embodiment.

FIG. 6 is a structure of a system for dissipating a heat of an LED lamp for a vehicle according to another embodiment.

Referring to FIG. 6, a system 600 for dissipating a heat of an LED lamp for a vehicle may include an LED drive module (LDM) 610, a first light source element 620, a second light source element 630, a thermoelement 640, and a battery 650 (or a third light source element 660 or another thermoelement 670).

As an example, the first light source element 620 may be the LED low/high lamp, and the second light source element 630 may be the daytime running light (DRL)/the position lamp (PSTN).

In FIG. 6, when the first light source element 620 is lit, heat dissipation starts. The heat dissipated by the first light source element 620 is transferred to one surface of the thermoelement 640 to raise a temperature of the corresponding surface. In this connection, a temperature difference between both surfaces of the thermoelement 640 occurs, and an electromotive force in the thermoelement 640 is generated by such temperature difference, thereby generating a current. The current generated by the thermoelement 640 may be used for charging the battery 650, used as power for the third light source element 660, or used as power for driving another thermoelement 670.

Figure 7:
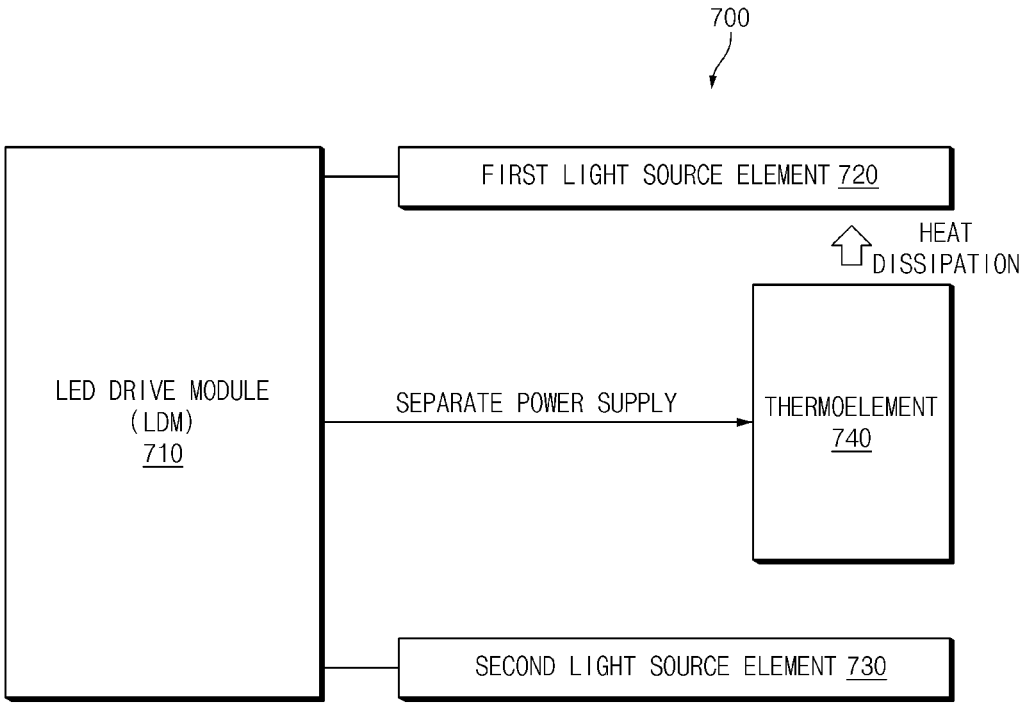
FIG. 7 is a structure of a system for dissipating a heat of an LED lamp for a vehicle according to another embodiment.

FIG. 7 is a structure of a system for dissipating a heat of an LED lamp for a vehicle according to another embodiment.

Referring to FIG. 7, a system 700 for dissipating a heat of an LED lamp for a vehicle may include an LED drive module (LDM) 710, a first light source element 720, a second light source element 730, and a thermoelement 740.

The LED drive module 710 may supply separate power required for driving the thermoelement 740.

One surface of the thermoelement 740 may be supplied with the power from the LED drive module 710 to cool a residual heat of the first light source element 720.

As an example, the first light source element 720 may be the LED low/high lamp, and the second light source element 730 may be the daytime running light (DRL)/the position lamp (PSTN).

The operations of the method or the algorithm described in connection with the embodiments disclosed herein may be embodied directly in hardware or a software module executed by the processor, or in a combination thereof. The software module may reside on a storage medium (that is, a memory and/or storage) such as a RAM, a flash memory, a ROM, an EPROM, an EEPROM, a register, a hard disk, a removable disk, and a CD-ROM.

The exemplary storage medium is coupled to the processor, which may read information from, and write information to, the storage medium. In another method, the storage medium may be integral with the processor. The processor and the storage medium may reside within an application specific integrated circuit (ASIC). The ASIC may reside within the user terminal. In another method, the processor and the storage medium may reside as individual components in the user terminal.

The description above is merely illustrative of the technical idea of the present disclosure, and various modifications and changes may be made by those skilled in the art without departing from the essential characteristics of the present disclosure. Therefore, the embodiments disclosed in the present disclosure are not intended to limit the technical idea of the present disclosure but to illustrate the present disclosure, and the scope of the technical idea of the present disclosure is not limited by the embodiments. The scope of the present disclosure should be construed as being covered by the scope of the appended claims, and all technical ideas falling within the scope of the claims should be construed as being included in the scope of the present disclosure.

The present disclosure according to an embodiment has an advantage of providing the device and the method for controlling the heat dissipation of the LED lamp for the vehicle using the thermoelement.

In addition, the present disclosure according to an embodiment has an advantage of providing the device and the method for controlling the heat dissipation of the LED lamp for the vehicle that arrange the headlamp, the fan, and the thermoelement such that the Seebeck effect may be used when lighting the low/high lamp of the LED lamp for the vehicle and the Peltier effect may be used when lighting the daytime running light (DRL)/the position lamp (PSTN), thereby utilizing the heat generated from the headlamp and the heat consumed by the resistance as the power for the LED heat dissipation.

In addition, the present disclosure according to an embodiment has an advantage of reducing a manufacturing cost of the system for dissipating the heat of the LED for the vehicle using the Seebeck effect without having a circuit and the like for sensing the temperature of the LED and calculating a driving output value for controlling the LED lamp heat dissipation.

In addition, the present disclosure according to an embodiment may use the residual power of the second light source element without using a separate signal or external power for power applied to a Peltier element, thereby reducing the power consumption, and accordingly, being able to be applied to the eco-friendly vehicle.

In addition, various effects that are directly or indirectly identified through the present document may be provided.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A method for controlling heat dissipation of an LED lamp, the method comprising:

applying power to a first light source to light the first light source;

generating a current using heat dissipation of the first light source;

supplying the current to a fan to drive the fan;

removing a residual heat of the first light source using air from the fan;

applying power to a second light source to light the second light source from a LED drive module, wherein the second light source is electrically separated from the first light source; and applying residual power from the LED drive module to a first surface of a thermoelement, wherein a temperature difference between the first surface and a second surface of the thermoelement occurs as the residual power is applied and the residual heat of the first light source is removed using cold air formed on the second surface of the thermoelement.

2. The method of claim 1, wherein the first light source is an LED low/high lamp.

3. The method of claim 2, wherein the current is generated by the thermoelement, the current being generated by an electromotive force generated based on the temperature difference between the first and second surfaces of the thermoelement resulting from the heat dissipation.

4. The method of claim 1, wherein the second light source comprises a daytime running light or a position lamp.

5. The method of claim 1, further comprising supplying the current to a battery.

6. The method of claim 1, further comprising supplying the current to another light source.

7. The method of claim 1, wherein the current is generated by the thermoelement.

8. The method of claim 7, wherein one surface of the thermoelement is embodied in a form of a substrate by stacking a light absorber.

9. The method of claim 7, wherein the thermoelement is attached to a housing or a heat sink corresponding to a heat dissipation portion of the first light source.

10. The method of claim 1, further comprising supplying the current to a second thermoelement.

11. A system for controlling heat dissipation of an LED lamp, the system comprising:

a first light source;

an LED drive module configured to apply power to the first light source to light the first light source;

a thermoelement configured to generate a current using heat dissipation of the first light source;

a fan configured to be driven by receiving the current as power, wherein the fan is configured to generate cold air when driven, and wherein the system is configured to use the cold air to remove a residual heat of the first light source; and a second light source configured to be driven by receiving power from the LED drive module, wherein the second light source is electrically separated from the first light source;

wherein the system is designed so that during operation:

residual power from the LED drive module is provided to a first surface of the second light source;

application of the residual power results in a temperature difference between the first surface and a second surface of the thermoelement; and the residual heat of the first light source is removed using cold air formed on the second surface of the thermoelement.

12. The system of claim 11, wherein the first light source is an LED low/high lamp.

13. The system of claim 12, wherein the thermoelement is configured to generate the current by an electromotive force generated based on the temperature difference between the first and second surfaces of the thermoelement resulted from the heat dissipation.

14. The system of claim 11, wherein one surface of the thermoelement is embodied in a form of a substrate by stacking a light absorber.

15. The system of claim 11, wherein the thermoelement is attached to a housing or a heat sink corresponding to a heat dissipation portion of the first light source.

16. The system of claim 11, further comprising a battery configured to be charged by receiving the current generated by the thermoelement.

17. The system of claim 11, further comprising a third light source configured to be driven by receiving the current generated by the thermoelement.

18. The system of claim 11, wherein the first light source is a low/high beam lamp and the second light source is a daytime running light or a position lamp.

19. A method for controlling heat dissipation within a vehicle, the method comprising:

applying power to a low/high beam LED lamp to light the low/high beam LED lamp;

generating a current using heat dissipation of the low/high beam LED lamp;

supplying the current to a fan to drive the fan;

removing residual heat of the low/high beam LED lamp using air from the fan;

applying power to a second light source to light the second light source from a LED drive module, wherein the second light source is a daytime running light or a position lamp; and applying residual power from the LED drive module to a first surface of a thermoelement, wherein a temperature difference between the first surface and a second surface of the thermoelement occurs as the residual power is applied, and the residual heat of the low/high beam LED lamp is removed using cold air formed on the second surface of the thermoelement.

20. The method of claim 19, wherein the thermoelement is attached to a housing or a heat sink corresponding to a heat dissipation portion of the low/high beam LED lamp.

* * * * *